US010718164B2

(12) United States Patent
Prill

(10) Patent No.: US 10,718,164 B2
(45) Date of Patent: Jul. 21, 2020

(54) DOWNHOLE VIBRATION ASSEMBLY AND METHOD OF USING SAME

(71) Applicant: DRECO ENERGY SERVICES ULC, Edmonton, Alberta (CA)

(72) Inventor: Jonathan Ryan Prill, Edmonton (CA)

(73) Assignee: Dreco Energy Services ULC, Alberta (CA)

( * ) Notice: Subject to any disclaimer, the term of this patent is extended or adjusted under 35 U.S.C. 154(b) by 182 days.

(21) Appl. No.: 15/565,224

(22) PCT Filed: Apr. 4, 2016

(86) PCT No.: PCT/CA2016/000099
§ 371 (c)(1),
(2) Date: Oct. 9, 2017

(87) PCT Pub. No.: WO2016/161502
PCT Pub. Date: Oct. 13, 2016

(65) Prior Publication Data

US 2018/0080284 A1 Mar. 22, 2018

Related U.S. Application Data

(60) Provisional application No. 62/144,801, filed on Apr. 8, 2015.

(51) Int. Cl.
*E21B 7/24* (2006.01)
*E21B 4/00* (2006.01)
*E21B 28/00* (2006.01)

(52) U.S. Cl.
CPC ..... *E21B 7/24* (2013.01); *E21B 4/003* (2013.01); *E21B 28/00* (2013.01)

(58) Field of Classification Search
CPC . E21B 4/003; E21B 4/006; E21B 4/06; E21B 4/10; E21B 6/02; E21B 7/24; F16C 19/10; F16C 33/58
See application file for complete search history.

(56) References Cited

U.S. PATENT DOCUMENTS 1,196,656 A * 8/1916 Bugbee ..... B28D 1/143 144/35.1
3,235,014 A 2/1966 Brooks
(Continued)

FOREIGN PATENT DOCUMENTS

CN 201778652 U 3/2011
CN 102465967 A 5/2012
(Continued)

OTHER PUBLICATIONS

International Search Report dated Jun. 22, 2016, for International Patent Application No. PCT/CA2016/000099 filed Apr. 4, 2016 (5 pgs).
(Continued)

*Primary Examiner* — Robert E Fuller
(74) *Attorney, Agent, or Firm* — Conley Rose, P.C.

(57) ABSTRACT

In at least one aspect, the disclosure relates to a vibration assembly for a downhole tool positionable in a subterranean formation. The vibration assembly includes a vibration race positioned in the downhole tool, the vibration race having a non-planar engagement surface. The vibration assembly also includes an additional race positioned in the downhole tool a distance from the vibration race, the additional race having another engagement surface facing the non-planar engagement surface of the vibration race. The vibration assembly also includes a cage positioned between the vibration race and the additional race and rollers positionable in the cage, the rollers rollably engageable with the non-planar engagement surface and the another engagement surface to vary the distance between the vibration race and the additional race whereby axial movement is provided in the downhole tool.

18 Claims, 16 Drawing Sheets

(56) References Cited

U.S. PATENT DOCUMENTS 3,363,700 A * 1/1968 Bogusch, Jr. ..... B25D 11/104 173/109
3,443,446 A * 5/1969 Buergel ..... F16H 25/125 74/22 R
3,659,464 A * 5/1972 Puyo ..... B06B 1/10 74/61
4,077,683 A 3/1978 Bhateja et al.
4,232,751 A * 11/1980 Trzeciak ..... E21B 4/02 166/237
5,116,147 A * 5/1992 Pajari, Sr. ..... E21B 4/00 173/48
5,664,891 A 9/1997 Kutinsky
6,155,360 A * 12/2000 McLeod ..... E21B 10/66 175/258
6,230,819 B1 * 5/2001 Chen ..... B25F 5/001 173/48
7,191,848 B2 * 3/2007 Ha ..... B25D 11/104 173/109
8,517,093 B1 8/2013 Benson
8,764,307 B2 7/2014 Brubaker et al.
2008/0099245 A1 5/2008 Hall et al.
2015/0023137 A1 1/2015 Benson
2018/0066488 A1 * 3/2018 Wiercigroch ..... B06B 1/10

FOREIGN PATENT DOCUMENTS

CN 104169597 A 11/2014
CN 104405287 A 3/2015

OTHER PUBLICATIONS

Chinese First Office Action dated Dec. 29, 2018, and Search Report for Application No. CN 201680020948.0.
Extended European Search Report dated Nov. 26, 2018, for Application No. EP 16775970.
Chinese Office Action dated Sep. 19, 2019, and Search Report for Application No. CN 201680020948.0.

* cited by examiner

DOWNHOLE VIBRATION ASSEMBLY AND METHOD OF USING SAME

CROSS-REFERENCE TO RELATED APPLICATIONS

This application is a 35 U.S.C. § 371 national stage application of PCT/CA2016/000099 filed Apr. 4, 2016, and entitled "Downhole Vibration Assembly and Method of Using Same," which claims priority to U.S. application No. 62/144,801 filed on Apr. 8, 2015, both of which are incorporated herein by reference in their entirety for all purposes.

BACKGROUND

This present disclosure relates generally to techniques for performing wellsite operations. More specifically, the present disclosure relates to downhole equipment, such as drilling tools.

Oilfield operations may be performed to locate and gather valuable downhole fluids. Oil rigs are positioned at wellsites, and downhole equipment, such as a drilling tool, is deployed into the ground by a drill string to reach subsurface reservoirs. At the surface, an oil rig is provided to deploy stands of pipe into the wellbore to form the drill string. Various surface equipment, such as a top drive, a Kelly and a rotating table, may be used to apply torque to the stands of pipe and threadedly connect the stands of pipe together. A drill bit is mounted on the downhole end of the drill string, and advanced into the earth from the surface to form a wellbore.

A bottom hole assembly (BHA) is provided along the drill string. The BHA may be provided with various downhole components, such as measurement while drilling, logging while drilling, telemetry, motors, and/or other downhole tools, to perform various downhole operations, such as providing power to the drill bit to drill the wellbore. Examples of BHAs or downhole components are provided in U.S. Patent/Applications Nos. US Patent/Application Nos. 2015/003438, 2009/0223676, 2011/0031020, U.S. Pat. Nos. 7,419,018, 6,431,294, 6,279,670, and 4,428,443, and PCT Application NO. WO2014/089457 the entire contents of which are hereby incorporated by reference herein.

SUMMARY

In at least one aspect, the disclosure relates to a vibration assembly for a downhole tool positionable in a subterranean formation. The vibration assembly includes a vibration race positioned in the downhole tool, the vibration race having a non-planar engagement surface. The vibration assembly also includes an additional race positioned in the downhole tool a distance from the vibration race. The additional race has another engagement surface facing the non-planar engagement surface of the vibration race. The vibration assembly also includes a cage positioned between the vibration race and the additional race and rollers positionable in the cage. The rollers are rollably engageable with the non-planar engagement surface and the another engagement surface to vary the distance between the vibration race and the additional race whereby axial movement is provided in the downhole tool.

The additional race may be a bearing race and the another engagement surface may be a planar engagement surface. The additional race may be another vibration race having another non-planar surface which may be identical to or different from the vibration race.

The vibration race, the additional race, and the cage may be ring-shaped members with a passage extending therethrough. The cage may have roller holes to receive the rollers therein. The rollers may be cylindrical, spherical, and/or frusto-conical.

The non-planar engagement surface may be a wavy surface extending radially about the vibration race. The non-planar engagement surface may be a circular channel extending into an inner surface of the vibration race. The circular channel may have a non-smooth surface. The non-planar engagement surface may have peaks and valleys in a smooth, curved, a sinusoidal, a stepped, a ramped, a symmetric, and/or an asymmetric configuration. The vibration race and the additional race may have connector holes to receive connectors therethrough for connection to the downhole tool.

In another aspect, the disclosure relates to a downhole tool positionable in a subterranean formation. The downhole tool includes a conveyance and a bottomhole assembly supported by the conveyance. The bottomhole assembly may include a housing and a vibration assembly. The vibration assembly may include a vibration race positioned in the downhole tool. The vibration race has a non-planar engagement surface. The vibration assembly also includes an additional race positioned in the downhole tool a distance from the vibration race. The additional race has another engagement surface facing the non-planar engagement surface of the vibration race. The vibration assembly also includes a cage positioned between the vibration race and the additional race, and rollers positionable in the cage. The rollers are rollably engageable with the non-planar engagement surface and the another engagement surface to vary the distance between the vibration race and the additional race whereby axial movement is provided in the downhole tool.

The conveyance may be a drill string and the bottomhole assembly may include a motor assembly, a bearing assembly, and a drill bit. The vibration assembly may be positioned in the bearing assembly. The bottomhole assembly may include a drive portion, an adjustment portion, and a bearing assembly. The vibration assembly may be positioned in the bearing assembly. The bearing assembly may include a crossover housing, bearing housings, and a bearing mandrel.

The bottomhole assembly may include an adjustment portion, and a bearing assembly. The adjustment portion may include a bearing housing and a bearing mandrel. The vibration assembly may be positioned between the bearing housing and the bearing mandrel. The adjustment portion may include a lock housing and an adjustment ring.

In another aspect, the present disclosure relates to a method of drilling a wellbore penetrating a subterranean formation. The method involves advancing a downhole tool with a vibration assembly into the subterranean formation. The vibration assembly may include a vibration race positioned in the downhole tool. The vibration race may have a non-planar engagement surface and an additional race positioned in the downhole tool a distance from the vibration race. The additional race may have another engagement surface facing the non-planar engagement surface of the vibration race. The vibration assembly may also include a cage positioned between the vibration race and the additional race, and rollers positionable in the cage in engagement with the non-planar engagement surface and the another engagement surface. The method also involves generating axial movement in the downhole tool by rotating the rollers along the non-planar engagement surface of the vibration race.

The generating may also involve varying the distance between the vibration race and the additional race by rotating the rollers along the non-planar engagement surface of the vibration race.

BRIEF DESCRIPTION OF THE DRAWINGS

So that the present disclosure can be understood in detail, a more particular description of the invention may be had by reference to the embodiments thereof that are illustrated in the appended drawings. It is to be noted, however, that the appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

The description that follows includes exemplary apparatuses, methods, techniques, and/or instruction sequences that embody techniques of the present subject matter. However, it is understood that the described embodiments may be practiced without these specific details.

The present disclosure relates to a downhole drilling tool including a bottomhole assembly (BHA) with a drill bit at an end thereof. The BHA also includes a downhole motor with a vibration assembly including races (e.g., a bearing race and/or a vibration race), a cage (or roller bearing), and rollers. The races may have various engagement surfaces (e.g., waves) along the races engageable by the rollers. A width of the vibration assembly varies as the rollers roll along the wavy (or curved) engagement surface of the vibration race to selectively extend and retract the BHA. The waves along the engagement surface may be defined to create movement (e.g., axial vibration) about the downhole tool. Such movement may be used, for example, to facilitate drilling and/or to prevent potentially damaging drilling effects, such as bit whirl, sticking and/or lateral vibration.

Figure 1:
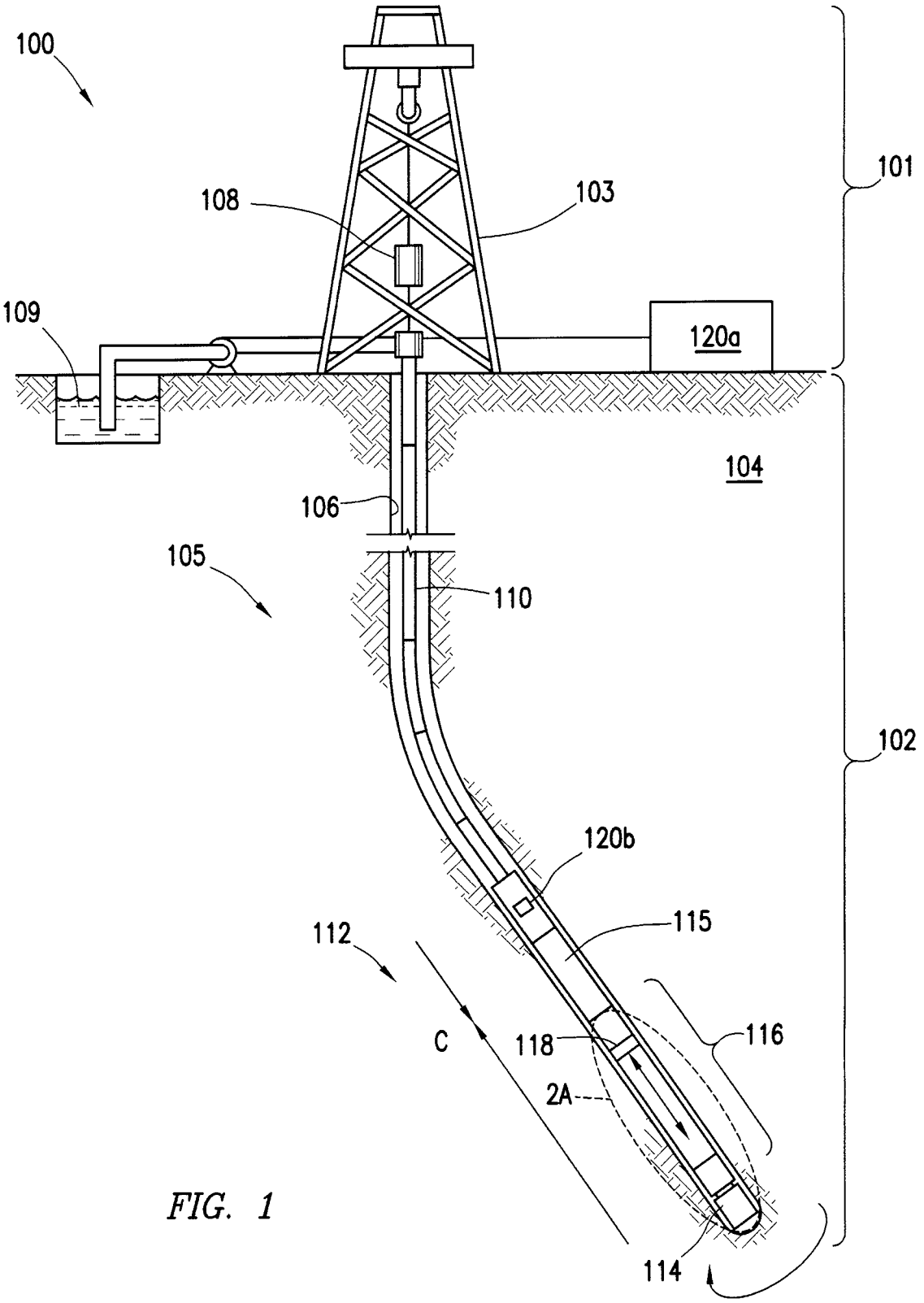
FIG. 1 depicts a schematic view, partially in cross-section, of a wellsite having a surface system and a subsurface system for drilling a wellbore, the subsurface system including a bottom hole assembly (BHA) with a motor assembly, a bearing assembly, and a vibration assembly.

FIG. 1 depicts a schematic view, partially in cross-section, of a wellsite 100. While a land-based drilling rig with a specific configuration is depicted, the present disclosure may involve a variety of land based or offshore applications. The wellsite 100 includes surface equipment 101 and subsurface equipment 102. The surface equipment 101 includes a rig 103 positionable about subterranean formation 104 for performing various wellbore operations, such as drilling a wellbore 106.

The surface equipment 101 may include various rig equipment 108, such as a Kelly, rotary table, top drive, elevator, etc., provided at the rig 103 to operate the subsurface equipment 102. A mud pit 109 may be provided as part of the surface equipment 101 for passing mud from the surface equipment 101 and through the subsurface equipment 102. Various flow devices, such as a pump may be used to manipulate the flow of mud about the wellsite 100.

The subsurface equipment 102 may include a downhole drilling tool 105 including a drill string 110 with a bottom hole assembly (BHA) 112 and a drill bit 114 at an end thereof. Fluid from the mud pit 109 may be passed through the drill string 110, BHA 112, and out drill bit 114 as the drill bit 114 is advanced into the formation 104 to form the wellbore 106.

The drill string 110 may include drill pipe, drill collars, tool joints, coiled tubing, and/or other tubulars used in drilling operations. The BHA 112 is at a lower end of the drill string 110 and contains various downhole components for performing downhole operations. As shown, the BHA 112 includes a motor assembly 115, a bearing assembly 116, and a vibration assembly 118.

The motor assembly 115 may be any motor usable to drive the drill bit 114, such as a fluid-driven drilling motor including a rotor and a stator and/or an electric motor. Examples of drilling motors are provided in U.S. Pat. No. 7,419,018, previously incorporated by reference herein. The bearing assembly 116 may be positioned between the motor assembly 115 and the drill bit 114, and have the vibration assembly 118 incorporated therein. The bearing assembly 116 may be configured for retrofitting with any conventional BHA, motor assembly, and/or drill bit.

The BHA 112 may also include various other downhole components, such as stabilizers, reamers, measurement tools (e.g., measurement while drilling tool, logging while drilling tool, gauges, etc.), communication devices (e.g., a telemetry unit), rotary steerables, and/or other downhole components. For example, the BHA 112 may include downhole components, such as a pulser, a shock tool, and/or other motion components, capable of generation motion. Examples of pulsers are provided in U.S. Pat. No. 6,279,670 and 2015/003438, previously incorporated by reference herein. An example pulser that may be used is the AGITATOR™ commercially available at www.nov.com. Examples of shock tools that may be used include the BLACK MAX MECHANICAL SHOCK TOOL™ or a GRIFFITH™ shock tool (e.g., 6¾" (17.14 cm) with a pump open area of 17.7 $in^2$ (114.19 $cm^2$) commercially available at www.nov.com.

The vibration assembly 118 and/or at least one other motion component may be used to provide movement, such as axial movement, of the downhole tool 105 as indicated by the double arrow. The movement of the downhole tool 105 may thereby be manipulated using various movement of the vibration assembly 118 alone or in combination with other motion components to achieve desired drilling. Movement may be used to affect drilling, for example, by moving the drill bit 114 to offset the damaging drilling effects. As indicated by the curved arrow, the BHA 112 is rotationally driven. As indicated by the arrows along the axis of BHA 112, as the drilling tool 105 is advanced into the wellbore 106, the BHA 112 may be subject to compression C.

One or more controllers 120*a,b* may be provided to operate the wellsite 100. For example, a surface controller 120*a* may be provided at the surface and a downhole controller 120*b* may be provided in the drilling tool 105. The controllers 120*a,b* may be provided with measurement and/or data control devices (e.g., processors, central processing units, etc.) to collect and/or analyze drilling data. The controller(s) 120*a,b* may operate the surface and/or subsurface equipment 101, 102 based on the drilling data.

Figure 2A:
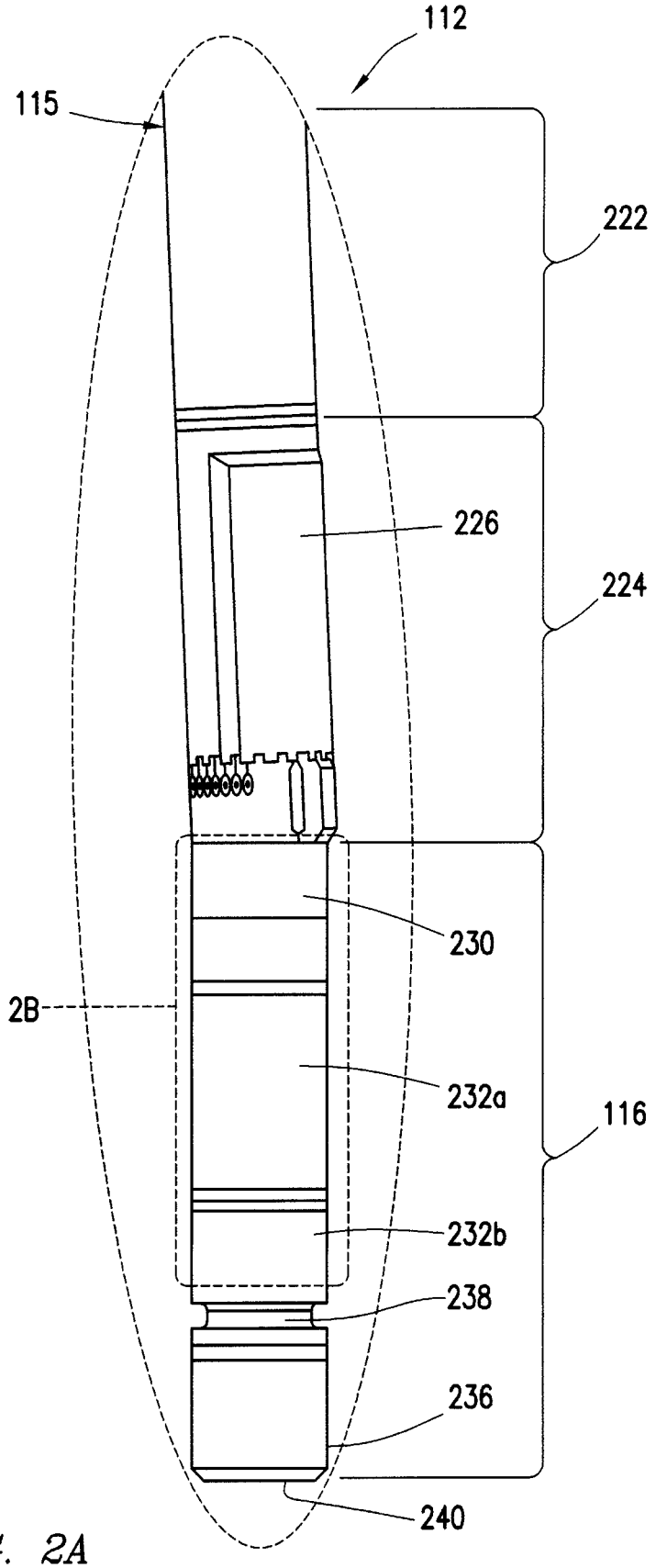
FIG. 2A is a perspective view of a portion 2A of the BHA of FIG. 1.
Figure 2B:
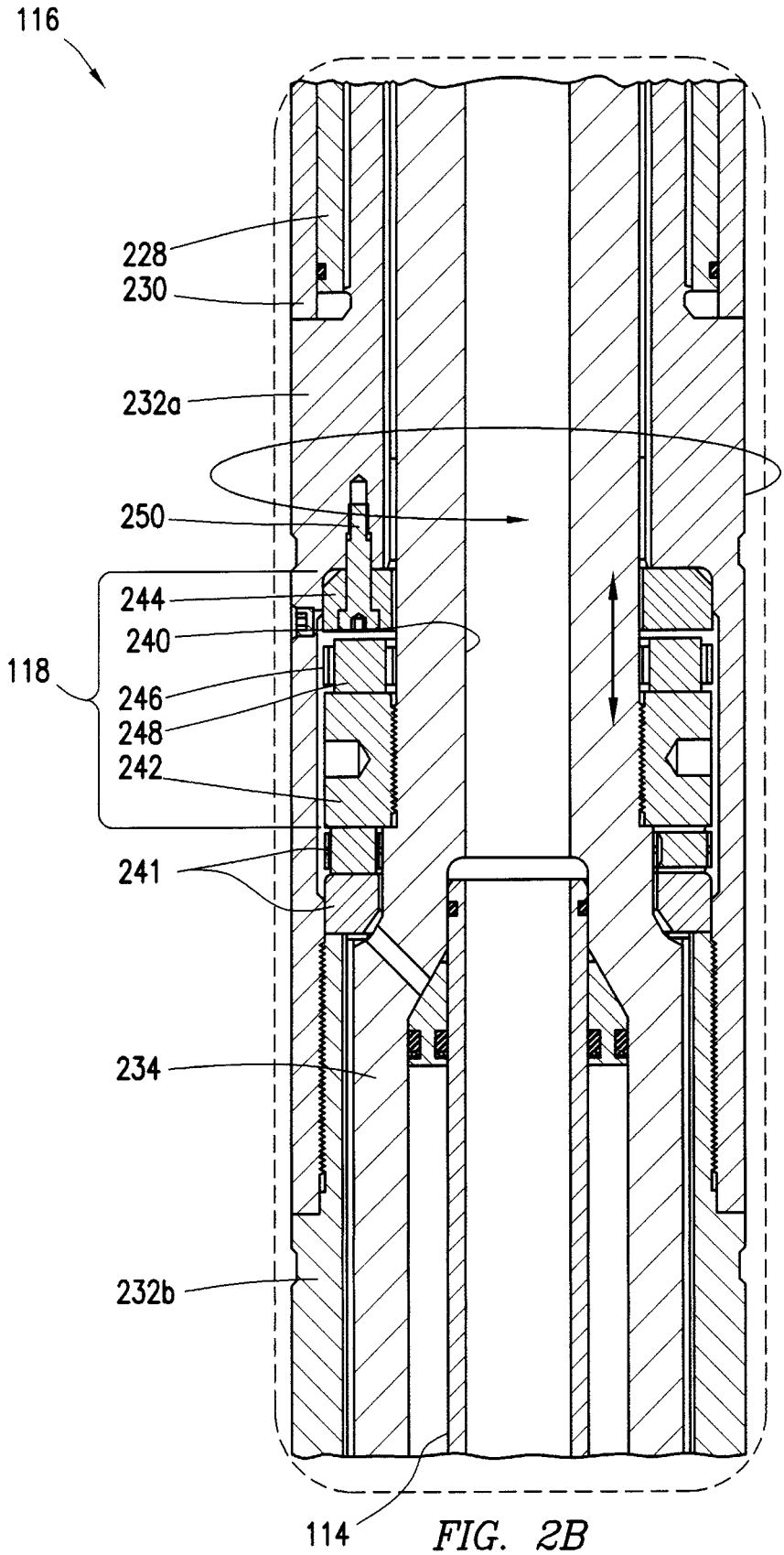
FIG. 2B is a cross-sectional view of a portion 2B of the BHA of FIG. 2A depicting the vibration assembly in greater detail.

FIGS. 2A and 2B show side and cross-sectional views of a portion of the BHA 112. FIG. 2A is a perspective view of a portion 2A of the BHA 112 of FIG. 1. FIG. 2B is a cross-sectional views of a portion 2B of the BHA 112 of FIG. 2A depicting the motor assembly 115, the bearing assembly 116, and the vibration assembly 118 in greater detail.

The motor assembly 115 includes a drive portion 222 and an adjustment portion 224. The drive portion 222 and the adjustment portions 224 may be positioned in collars (e.g., drill collars). The collars may be connectable to other components of the BHA 112 and/or the drill string (e.g., 110 of FIG. 1). The drive portion 222 may include various motor components, such as a stator (e.g., mono-drive and/or helical stator) and rotor (e.g., helical rotor) driven by fluid passing therethrough, gears, and/or electronics to generate power to drive the bit 114.

The adjustment portion 224 may operatively connect the motor assembly 115 to the bearing assembly 116 to translate drive from the motor assembly 115 to the drill bit 114. The adjustment portion 224 may include various adjustment components, such as a lock housing 226.

The bearing assembly 116 includes a crossover housing 230, a bearing housings 232*a,b*, a bearing mandrel 234. The crossover and bearing housings 230, 232*a,b* may be tubular portions for connecting and/or receiving portions of the BHA 112 and/or permit the passage of fluid therethrough. The bearing housings 232*a,b* may include multiple portions as shown. The bearing housing 232*a* is connectable to the adjustment portion 224 via the crossover housing 230. An adjustment ring 228 is provided between the bearing housing 232*a* and the crossover housing 230.

The bearing mandrel 234 is receivable into the bearing housing 232*b* and extends downhole therefrom. The bearing mandrel 234 may be positioned between the bearing housing 232*b* and the drill bit 114 (FIG. 1). The bearing mandrel 234 may include a bit box 236 with a bit shaft 238 extending therefrom and a fluid passage 240 therethrough. The bit box 236 may be connectable to the drill bit 114 for translating rotation from the motor assembly 115 thereto.

The vibration assembly 118 is positioned in the bearing assembly 116. In particular, the vibration assembly 118 is positioned within the bearing housing 232*a* along an outer surface of the bearing mandrel 234. The bearing mandrel 234 may have a stepped outer surface with a mandrel shoulder and the bearing housing 232*a* has a housing shoulder defining a space therebetween to support the vibration assembly 118 therein. Spacers (or rings, seals, and or other supports) 241 may be provided therein to support the vibration assembly 118.

The vibration assembly 118 includes a bearing race 242, a vibration race 244, a cage 246, rollers 248, and connectors 250. The rollers 248 are positioned between the bearing race 242 and the vibration race 244. The cage 246 rotationally supports the rollers 248. The vibration race 244 may be fixed to the bearing housing 232*a* by connectors 250, such as shoulder bolts. The vibration assembly 118 may be configured to provide additional movement (e.g., axial movement, hammering, vibration, etc.) of the BHA 112 as indicated by the double arrow.

The bearing race 242 and the vibration race 244 may each have engagement surfaces engageable with the rollers 248. The shape of the surfaces may define movement of the rollers 248 therealong whereby the movement, such as axial movement as shown by the double arrow, may be provided as is described herein. Any number of rollers and openings in the cage may be provided to achieve the desired movement.

Figure 3A:
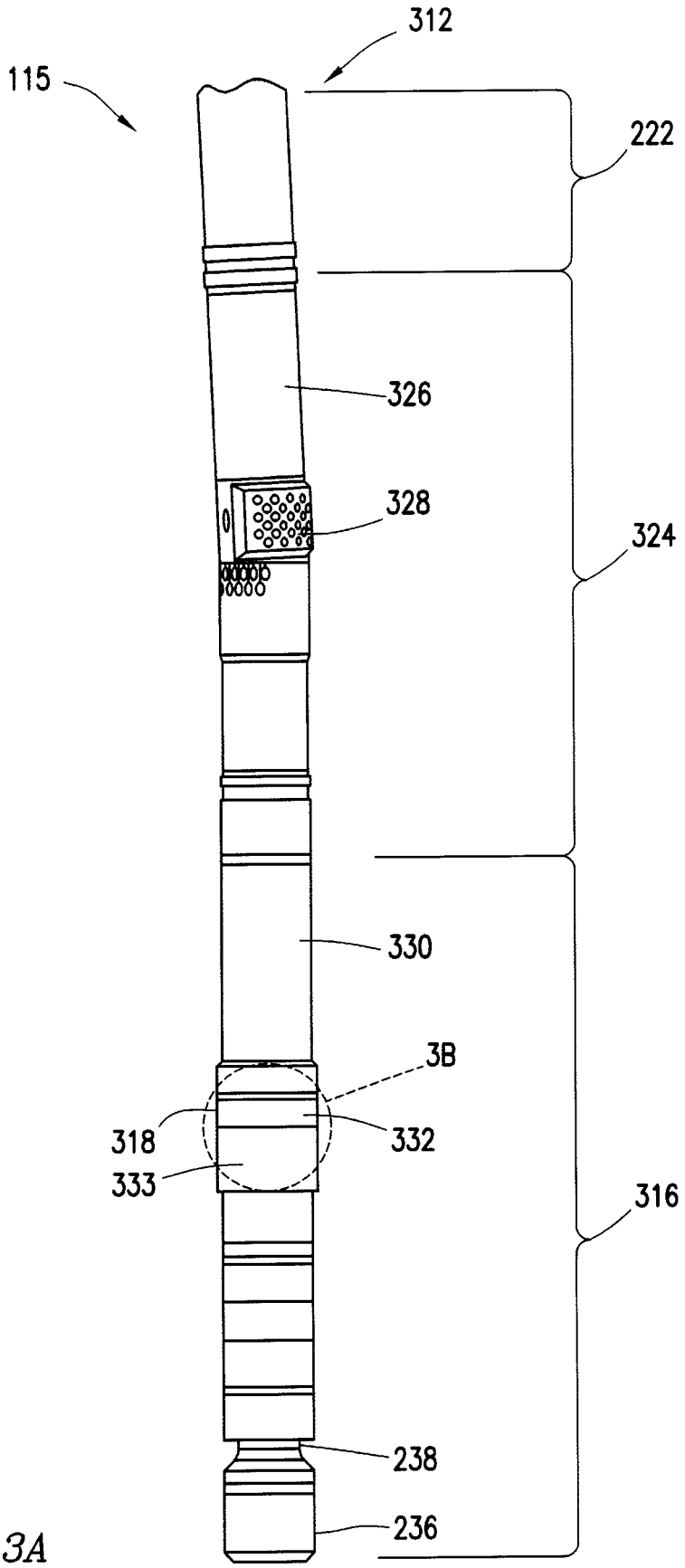
FIG. 3A is a perspective view of another version of the BHA with another vibration assembly.
Figure 3B:
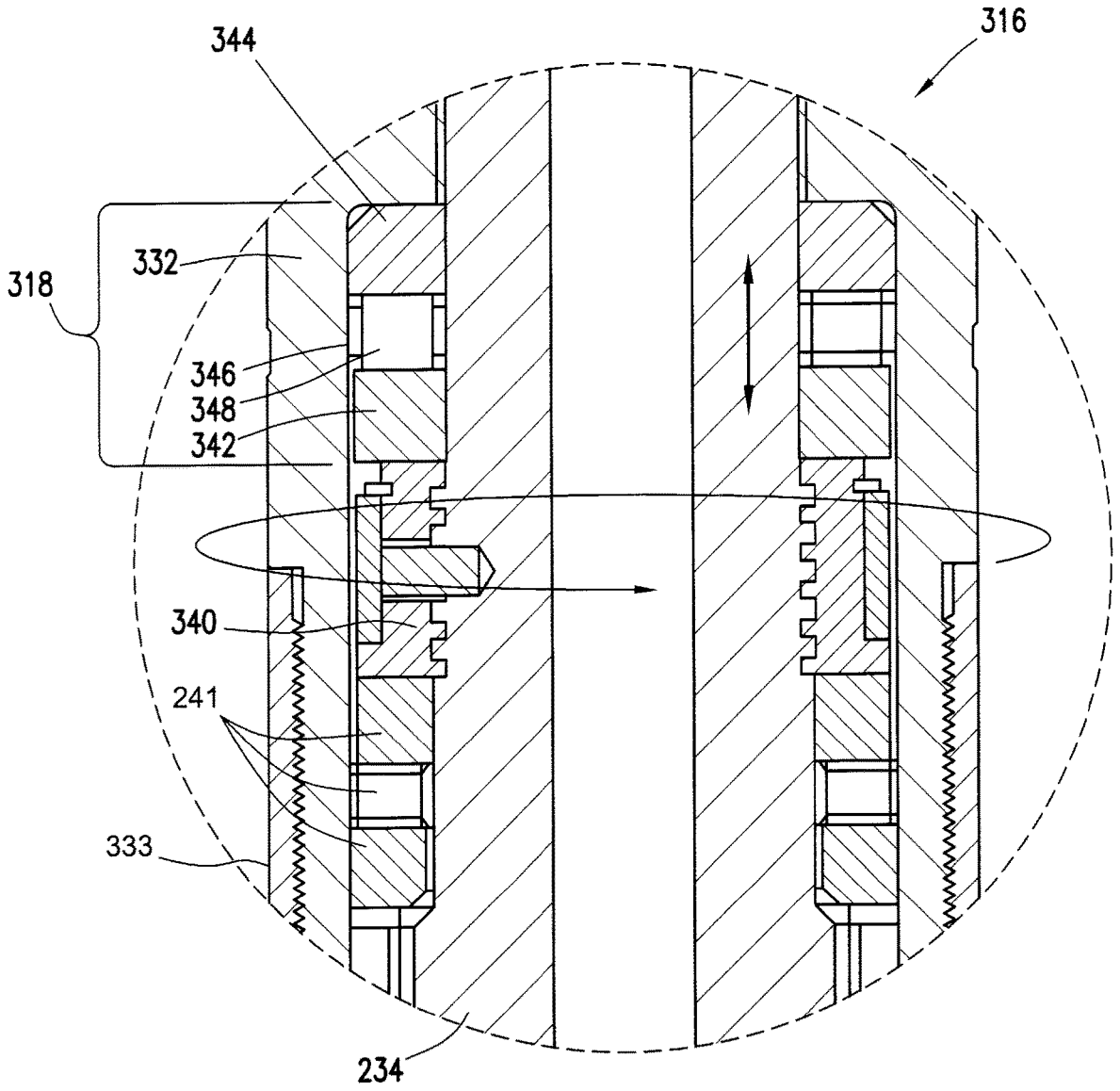
FIG. 3B is a cross-sectional view of a portion 3B of the BHA of FIG. 3A depicting the vibration assembly in greater detail.

FIGS. 3A and 3B show side and cross-sectional views of another configuration of a portion of the BHA 312. FIG. 3B shows a detailed view of a portion 3B of FIG. 3A. The BHA 312 may be similar to the BHA 112 as previously described, except with a different adjustment portion 324, bearing assembly 316 and vibration assembly 318.

In this version, the adjustment portion 324 has locking housing 326 and adjustment ring 328 in a different configuration. The bearing assembly 316 extends downhole from the adjustment portion 324 and includes crossover housing 330 and the vibration assembly 318. The crossover housing 330 connects a bearing housing 332 to the adjustment portion. The bearing housing 332 is a tubular member with the bearing mandrel 234 extending therein. The bearing housing 332 extends from the mandrel 234 to the crossover housing 330 and has a stabilizer sleeve 333 threadedly connected to an outer surface thereof.

The vibration assembly 318 is positioned between the bearing housing 332 and the mandrel 234. Locking spacers 340 and additional spacers 241 are provided in the space between the bearing housing 332 and the bearing mandrel 234 to support the vibration assembly 318. The locking spacers 340 may be threaded onto an outer surface of the mandrel 234.

The vibration assembly 318 includes a bearing race 342, a vibration race 344, a cage 346, and rollers 348. The vibration assembly 318 and its components are similar to those of FIGS. 2A and 2B, except that the vibration race 344 has no connectors and is frictionally supported in position, but could optionally be provided with connectors. The vibration race 344 may have a different configuration to provide a different movement (e.g., axial movement, hammering, vibration, etc.) of the BHA 312 as indicated by the double arrow.

Figure 4B:
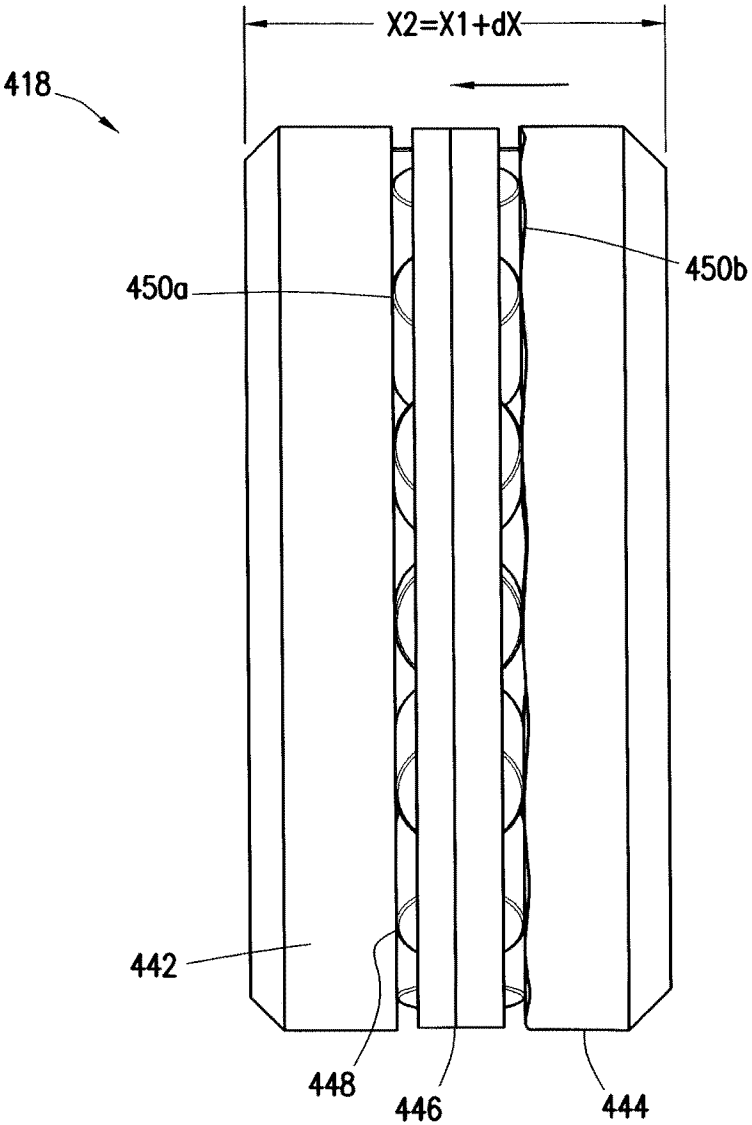
FIGS. 4A and 4B are side views of a vibration assembly in a retracted and extended position, respectively.
Figure 4A:
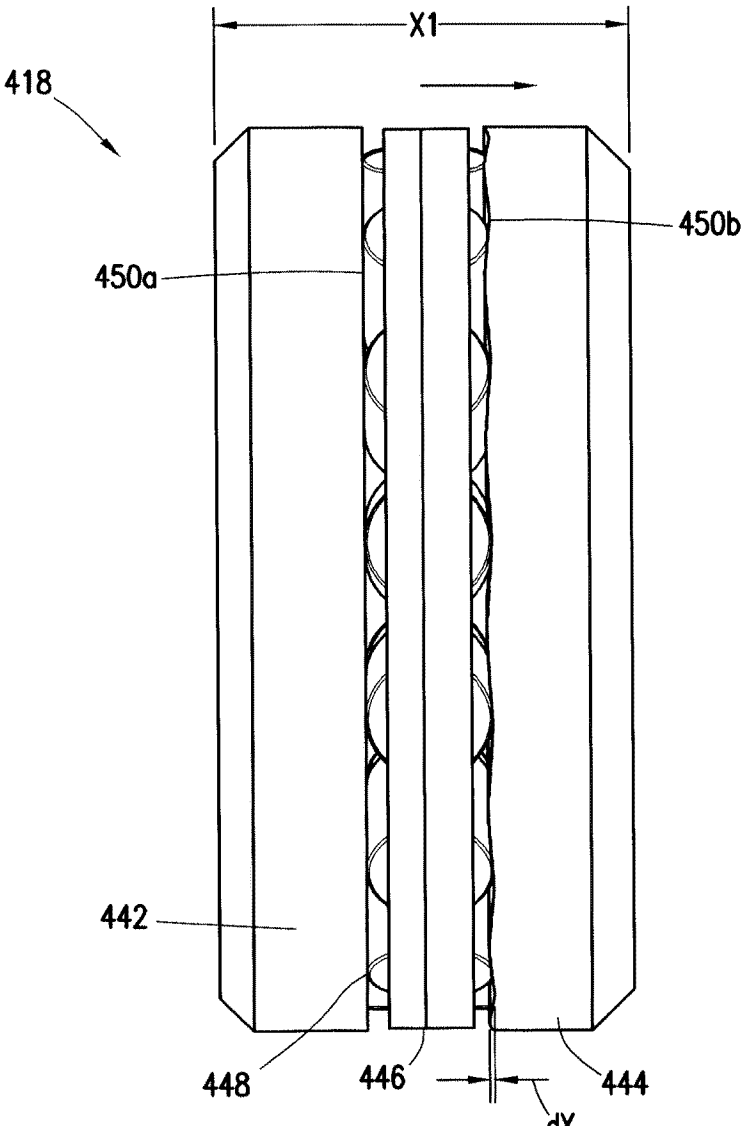
Figure 5B:
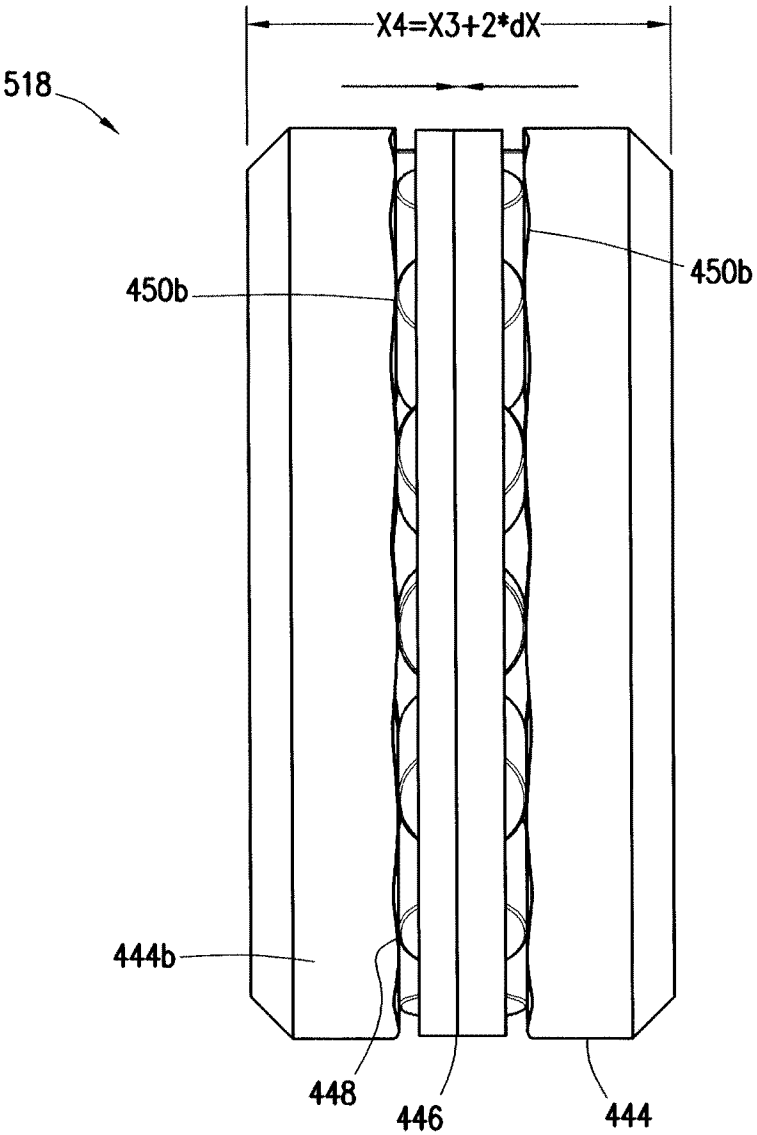
FIGS. 5A and 5B are side views of another vibration assembly in a retracted and extended position, respectively.

FIGS. 4A-5B depict various configurations of a vibration assembly 418, 518. FIGS. 4A and 4B show the vibration assembly 418 in a retracted and an extended position, respectively. FIGS. 5A and 5B show the vibration assembly 518 in a retracted and an extended position, respectively.

The vibration assemblies 418, 518 may be usable as the vibration assemblies 118, 318 previously described.

The vibration assembly 418, includes a bearing (flat surface) race 442, a vibration (curved surface) race 444*a*, a cage 446, and rollers 448 similar to those of the vibration assemblies 118, 318. The vibration assembly 518, includes a pair of the vibration (curved surface) races 444*b*, cage 446, and rollers 448. As shown in these versions, the bearing race 442 and the vibration race 444 each have an engagement surface 450*a,b*, respectively, thereon for engaging the rollers 448.

Figure 5A:
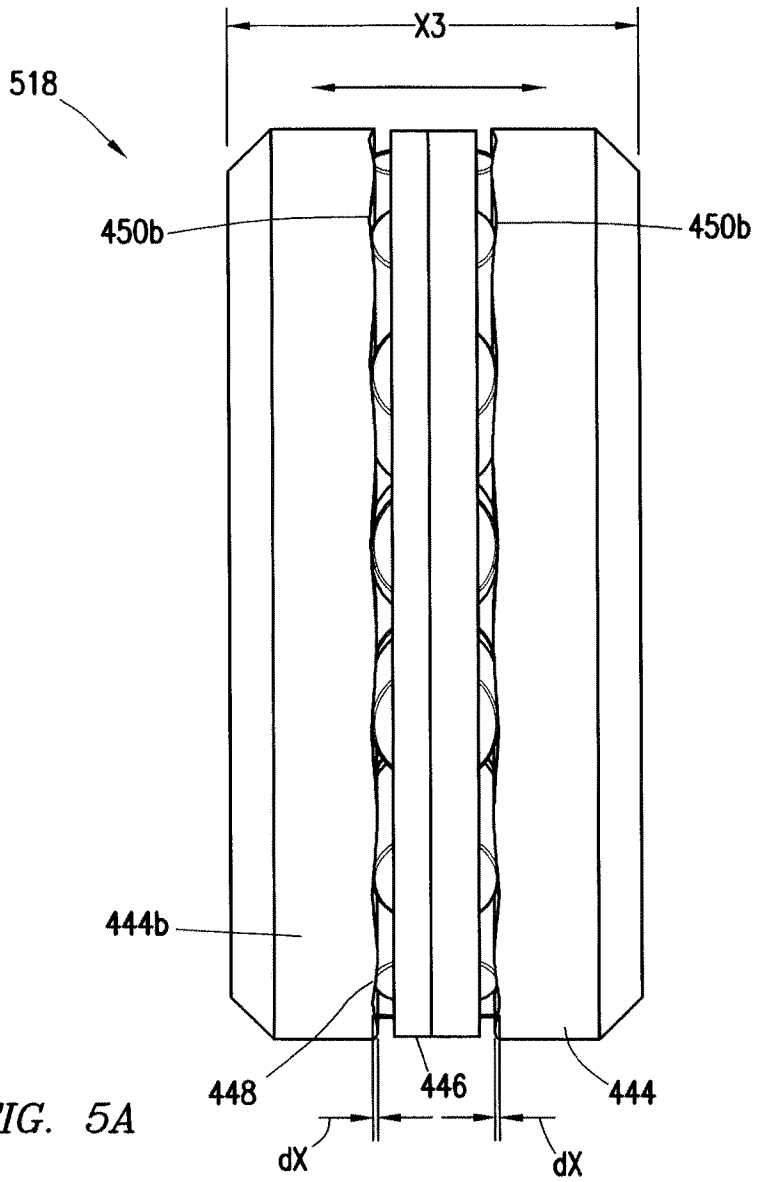

As shown in FIGS. 4A and 4B, the bearing race 442 and the vibration race 444 each have a planar (e.g., flat) engagement surface 450*a* and a nonplanar (e.g., wavy) engagement surface 450*b*, respectively. As shown in FIGS. 5A and 5B, the vibration races 444 each have an engagement (or rolling) surface 450*b* thereon. The rollers 448 of FIGS. 4A and 4B roll along the engagement surfaces 450*a,b*, and the rollers 448 of FIGS. 5A and 5B roll along the engagement surfaces 450*b*.

The bearing race 442 may have a planar surface 450*a* for smooth engagement with the rollers 448, and the vibration race 444 may have a non-planar (e.g., wavy) surface 450*b* for driving the rollers 448 therealong. In some cases, the bearing race 442 may be replaced with another vibration race provided with a non-planar surface 450*b* the same as or different from the vibration race 444.

The cage 446 may be positionable between the vibration race 444 and the bearing race 442 or between pairs of the vibration races 444. The cage 446 may be used to keep the rollers 448 in a desired position about (e.g., equidistant along) the engagement surfaces 450*a,b*. The cage 446 is a ring shaped member configured to rotationally support the rollers 448 therein and/or to prevent sticking and/or jamming. With the rollers 448 in position in the cage 446, the rollers 448 extend a distance from the cage 446 for engagement with the engagement surfaces 450*a,b* of the bearing race 442 and/or vibration race 442.

In some cases, the cage 446 may be eliminated and the rollers 448 may be supported between the races so that the rollers 448 contact each other around the circumference of the races and keep themselves equidistant thereabout. This cageless version may be used, for example, with mud-lubricate bearing stacks.

A constant gap is defined between the cage 446 and the engagement surfaces 450*a*, and a variable gap is defined between the cage 446 and the engagement surface 450*b*. When the BHA 112 is in compression (see, e.g., C of FIG. 1), the rollers 448 in the cage 446 roll along the engagement surfaces 450*a,b* of the bearing race 442 and the vibration race 444. Such rolling may provide a cam effect for rolling contact between the rollers 448 and the engagement surfaces 450*a,b*. The bearing race 442 and/or the vibration race 444 may be provided with engagement surfaces 450*a,b* defined to selectively extend and retract the vibration assembly to vary a width of the vibration assembly 418, 518.

As the rollers 448 engage the smooth engagement surfaces 450*a*, no change in width of the vibration assembly 418 is provided. As the rollers 448 engage the wavy engagement surface 450*b*, the vibration assembly 418 changes width. As shown in FIGS. 4A and 4B, the wavy engagement surface 450*b* moves the vibration assembly 418 between a retracted position of FIG. 4A with a width of X1 to an extended position 4B with a width of X2. The amount of movement is determined by the dimension of the wave along the wavy engagement surface 450*b*. As shown, the waves of the wavy engagement surfaces 450*b* have an overall length of dX defining a range of movement and change of width of the vibration assembly 418 as follows:

$$X2=X1+dX \quad \text{Eqn. (1)}$$

As shown in FIGS. 5A and 5B, the wavy engagement surfaces 450*b* move the vibration assembly 518 between a retracted position of FIG. 5A with a width of X3 to an extended position 5B with a width of X4. The amount of movement is determined by the dimension of the wave along both of the wavy engagement surface 450*b*. As shown, the waves of each of the wavy engagement surfaces 450*b* have a peak and valley defining an overall length of 2*dX (1dX for each surface 450*b*) defining a range of movement and change of width of the vibration assembly 518 as follows:

$$X4=X3+2*dX \quad \text{Eqn. (2)}$$

Referring to FIGS. 2A-5B, variations in the engagement surface 450*a,b* of the vibration races 444 causes the bearing housing and all attached components of the BHA 112 to move axially according to the length dX, of waves along the engagement surface 450*b*. The number of valleys in the vibration race 444 may correspond to the number of the rollers in the cage and may be evenly spaced thereabout.

The number of rollers 448 may determine a vibration frequency with respect to a rotational speed of the bearing mandrel 234 compared to the bearing housing 232*a*. For example, 15 rollers may be used to provide 7.5 hz at 60 RPM (and harmonics thereof). For a 120 RPM motor, a 15 hz axial vibration may be generated. The cage 446 may rotate at about one half of the rotational speed when the roller 448 is in rolling contact with the engagement surface 450*b*.

An amplitude of vibration may be affected by a length of the waves (e.g., dX) in the engagement surface 450*b*. The bearing race 442 and/or the vibration races 444 may be timed to each other to provide desired engagement. If both races are perfectly misaligned, the cage 446 may shuttle between the races without causing axial movement.

The vibration races may include nonplanar (e.g., variable, ramping surfaces) to induce axial movement of the upper portion of the motor housing of the BHA 112 with respect to the mandrel 234 and drill bit 114 (see, e.g., FIG. 2). This slight movement may be used to create a benign vibration to the BHA 112 that may be used to increase drilling performance. In an example, a small vibration may be provided along the BHA to move the mandrel 234 without causing damages to components of the BHA, such as seals (e.g., Kalsi seals). The vibration may be generated at about 8 times per rotation of the BHA and vibrate at from about 0.03 inches (0.76 mm) to about 0.045 inches (1.143 mm).

Figure 6A:
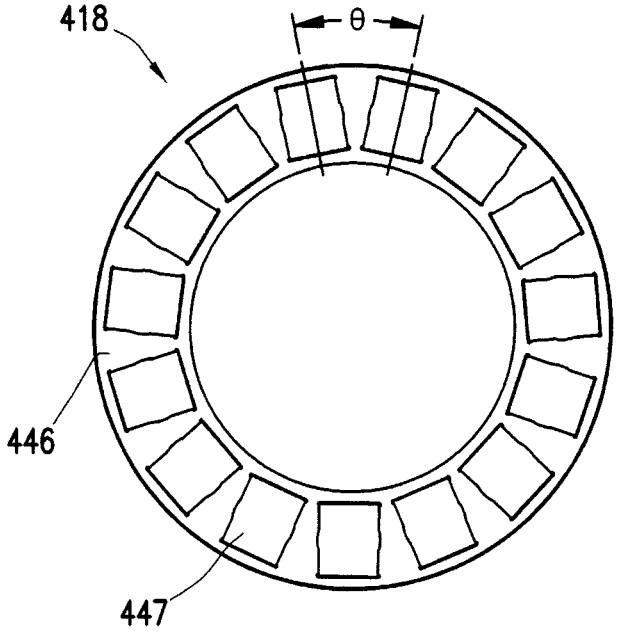
FIG. 6A-6C are front, perspective, and exploded views, respectively, of a portion of the vibration assembly of FIG. 4A.
Figure 6B:
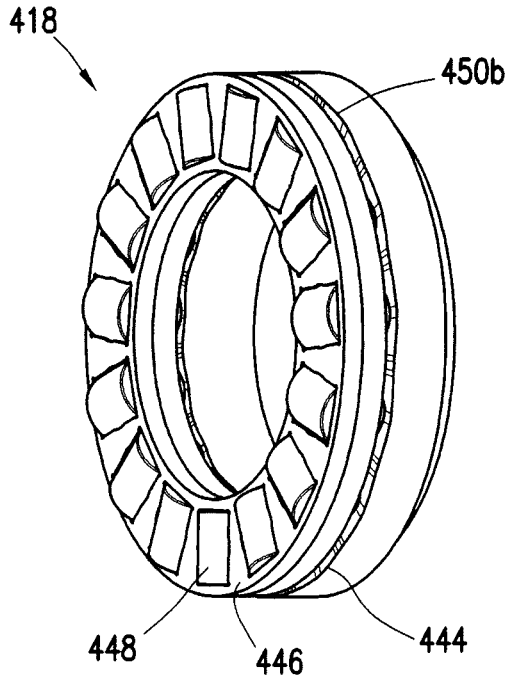
Figure 6C:
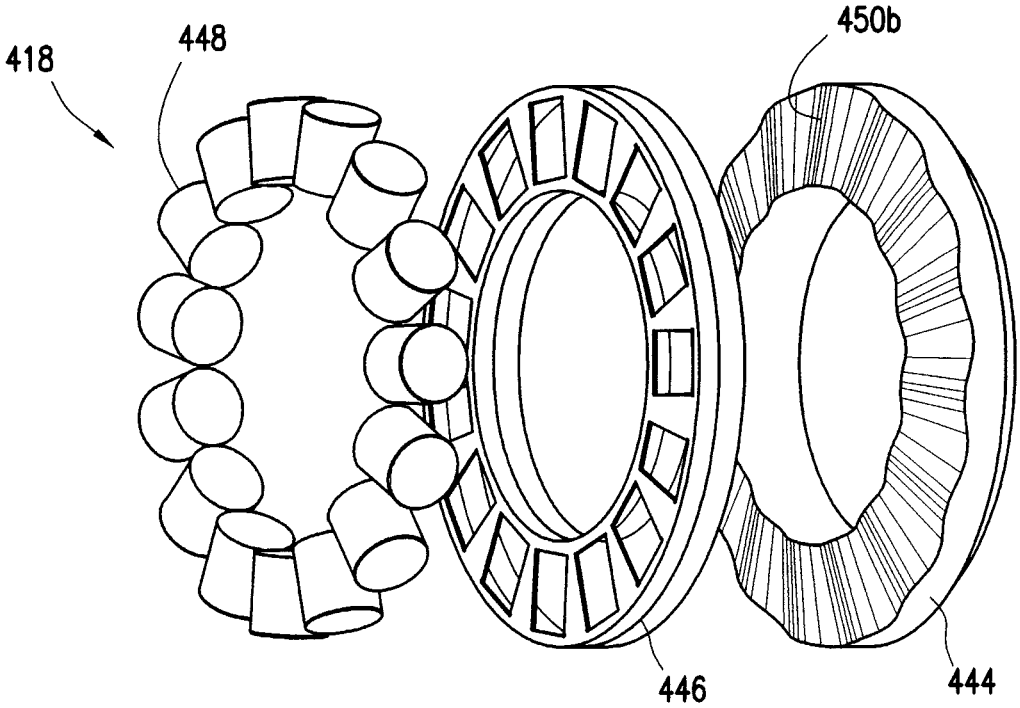

FIGS. 6A-6C show front, perspective and exploded views, respectively, of a portion of the vibration assembly 418 with the bearing race 442 removed. As shown in these views, the rollers 448 are cylindrical rollers positioned at an angle θ about the cage 446. The cylindrical rollers 448 are depicted as being equally spaced about the cage 446. The cage 446 may be aligned with radiuses of the cage 446 at various angles thereabout, and may be in various locations, spacing, angles, and/or placement. Equal spacing and angles may be provided to define a gap that remains the same at all angles about the cage 446. Offset rollers may optionally be provided to define a gap of various thicknesses about the cage 446.

The cage 446 is depicted as a ring shaped member with rectangular holes 447 to receive the rollers 448 therein. The vibration race 444 is a ring shaped member having the engagement surface 450*b* thereon. The cage 446 is positionable adjacent the engagement surface 450*b* of the vibration race 444. The engagement surface 450*b* is depicted as a wavy surface having waves thereon to rollingly engage the rollers 448. In this example, the rollers 448 may roll along the waves of the engagement surface 450*b* at a predefined speed along the vibration race 444.

Figure 7C:
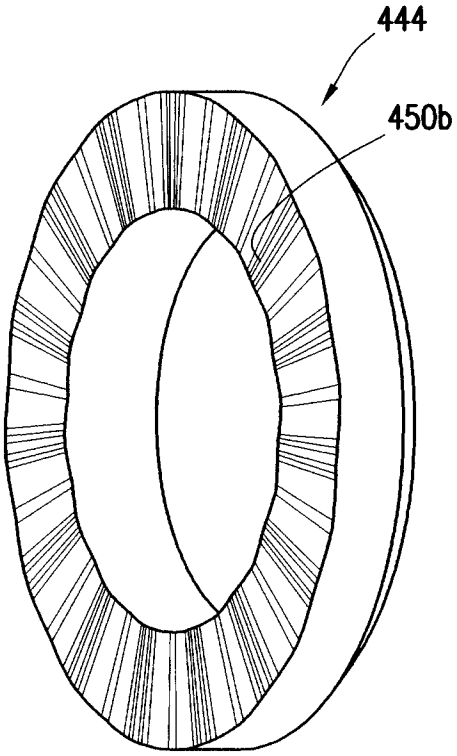
FIGS. 7A-7C are front, side and perspective views, respectively of a vibration race having a curved vibration surface.
Figure 7B:
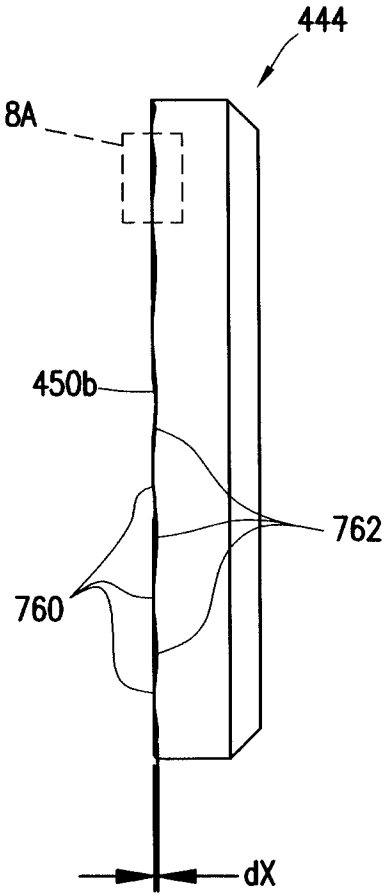
Figure 7A:
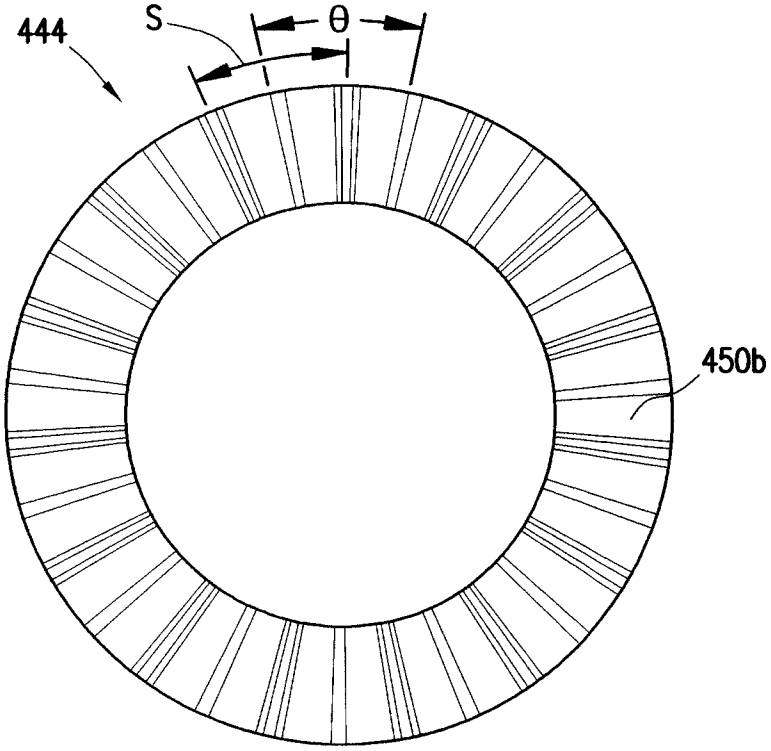
Figure 8A:
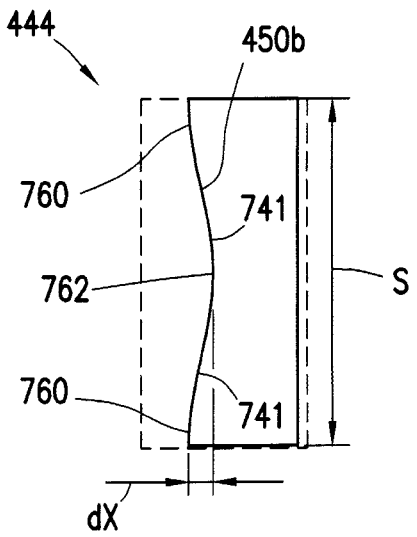
FIG. 8A is a detailed view of a portion 8A of the curved vibration race of FIG. 7B.

FIGS. 7A-8A show various views of the vibration race 444 in a curved (or floating) configuration. FIGS. 7A-7C show front, side and perspective views, respectively of the vibration race 444. FIG. 8A shows a detailed view of a portion 8A of the vibration race 444 of FIG. 7B. The vibration race 444 has peaks 760 and valleys 762 (or depressions) with symmetric inclined surfaces 741 therebetween along the engagement surface 450*b* of the vibration race 444. Peaks 760 are at an angle θ corresponding to the angle θ of the rollers of FIG. 6A.

As shown in these views, the engagement surface 450*b* may have a sinusoidal shape with a smooth transition between the peaks 760 and the valleys 762 along the engagement surface 450*b*. The sinusoidal shape may have a length S between the peaks 760. A vertical length between the peaks 760 and the valleys 762 is shown as dX. The shape and dimension provided by the sinusoidal wave may be varied to change axial acceleration of the BHA 112, thereby providing movement, such as vibration.

Figure 8B:
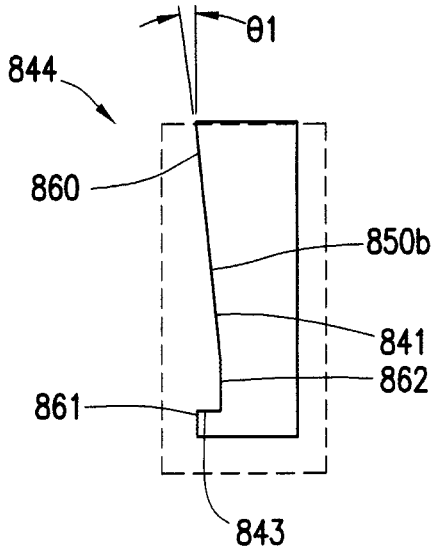
FIG. 8B is a detailed view of a portion of a stepped vibration race.

FIG. 8B shows an alternate version of the vibration race 844 with an optional variation of a stepped engagement surface 850*b*. In this version, the engagement surface 850*b* has a valley 862 between peaks 860, 861. The engagement surface 850*b* has an inclined surface 841 and a vertical surface 843 defining a step along the engagement surface 850*b* between peaks 860, 861. This step provides for smooth rolling along the inclined surface 841 at angle θ1, and a sudden drop off along the step 843.

Figure 10A:
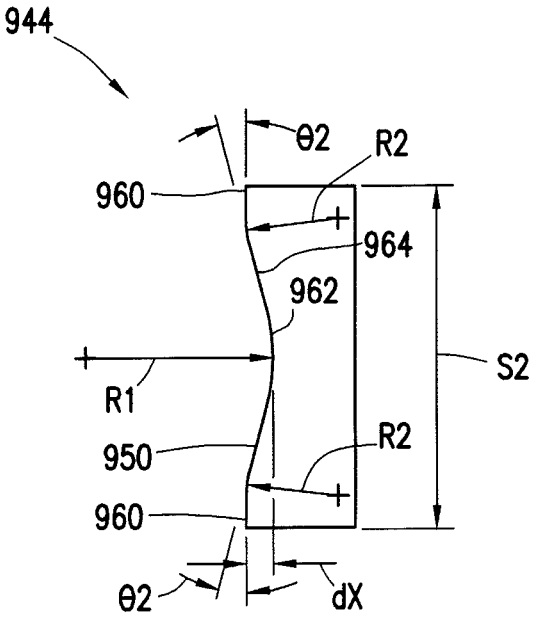
FIG. 10A is a detailed view of a portion 10A of the ramped vibration race of FIG. 9B.
Figure 9C:
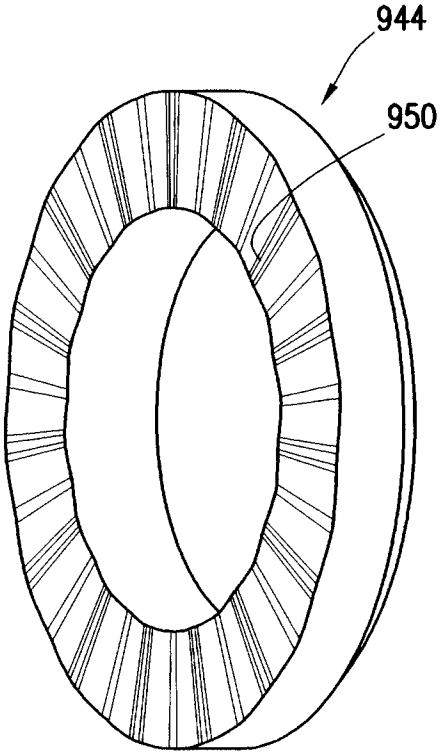
FIGS. 9A-9C are front, side and perspective views, respectively of another vibration race having a ramped vibration surface.
Figure 9B:
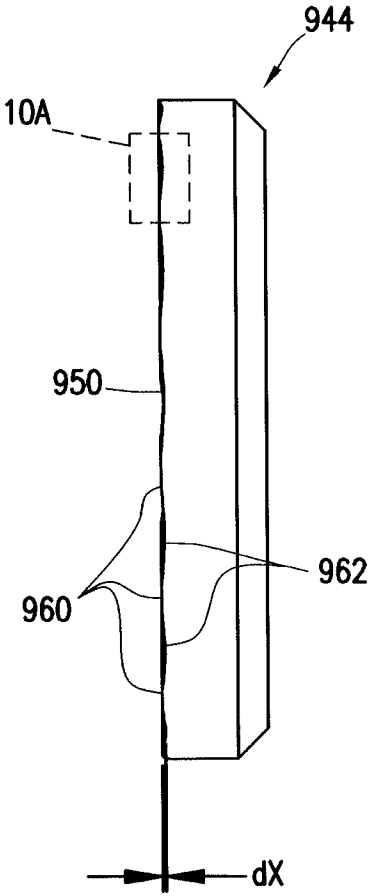
Figure 9A:
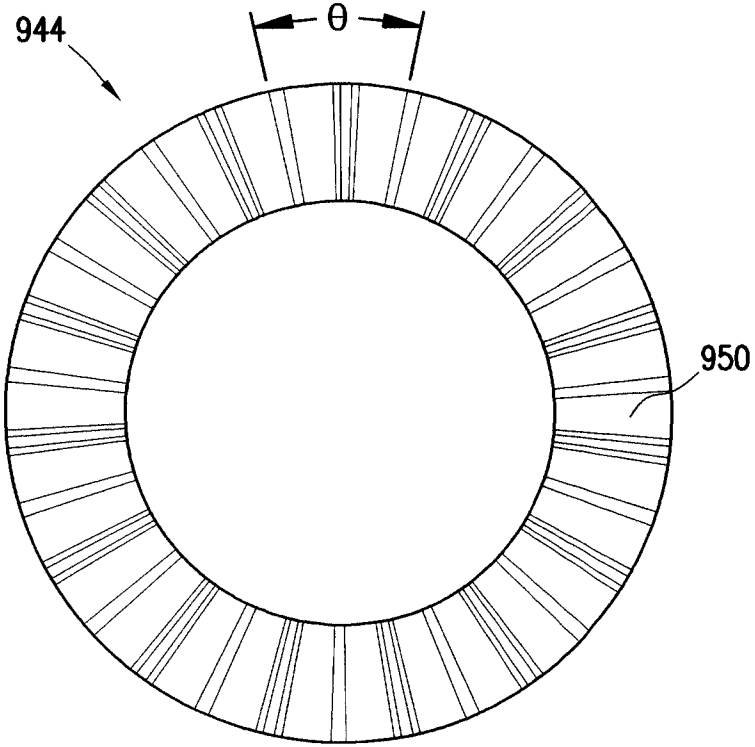

FIGS. 9A-10A show another version of the vibration race 944 in a ramped configuration. FIGS. 9A-9C show front, side and perspective views, respectively of the vibration race 944. FIG. 10A shows a detailed view of a portion 10A of the vibration race 944 of FIG. 9B. The vibration race 944 has peaks 960 and valleys 962 at angle θ2 along the engagement surface 950 of the vibration race 944.

In this version, the engagement surface 950 has a profile with peaks 960 including symmetric ramps (or inclines) 964 between the flat peaks 960 and curved valleys 962. The valley 962 has a radius R1 and the ramp 964 has a radius R2. The ramp 964 inclines at an angle θ2 from the flat peak 960.

Figure 10B:
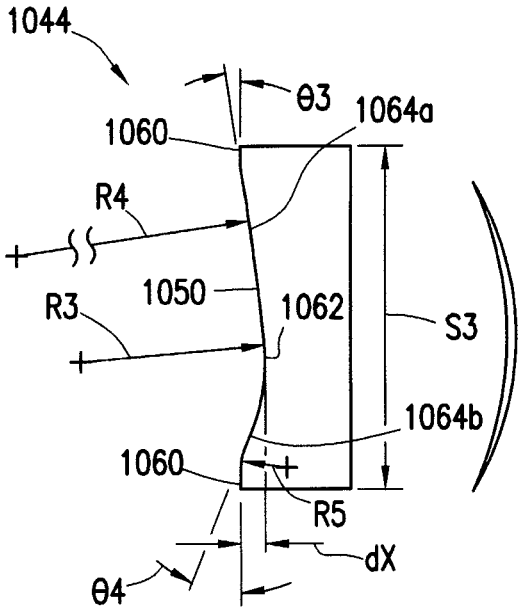
FIG. 10B is a detailed view of a portion of an offset ramped vibration race.

FIG. 10B shows an alternate version of the vibration race 1044 of FIG. 10B. The vibration race 1044 has peaks 1060 and valleys 1062 along the engagement surface 1050 of the vibration race 1044. In this version, the engagement surface 1050 has a profile with the peaks 1060 including asymmetric ramps (or inclines) 1064*a,b* between the flat peaks 1060 and the curved valleys 1062. The valley 1062 has a radius R3, a first ramp 1064*a* has a radius R4, and a second ramp 1064*b* has a radius R5. The radii R4 and R5 are different to define an asymmetric configuration. The ramp 1064*a* inclines at an angle θ3 to the flat peak 1060, and the ramp 1064*b* inclines at an angle θ4 to the flat peak 1060.

As shown in FIGS. 9A-10B, the engagement surfaces 950, 1050 may have a symmetrical or asymmetrical shape with ramped transition between flat peaks 960, 1060 and the valleys 962, 1062 along the engagement surface 950, 1050. The ramped shape may have a length S2, S3 between the peaks 960, 1060. A vertical length between the peaks 960, 1060 and the valleys 962,1062 is shown as dX. The shape and dimension provided by the ramped wave may be varied to change axial acceleration of the BHA 112, thereby providing movement, such as vibration. The shape and dimension provided by the wavy surface 950,1050 may be varied to change axial acceleration of the BHA 112, thereby providing movement, such as vibration. In an example, the ramp configuration may be selected to provide rolling at a desired speed, such as ½a speed of the rotation of the bearing race.

Figure 11:
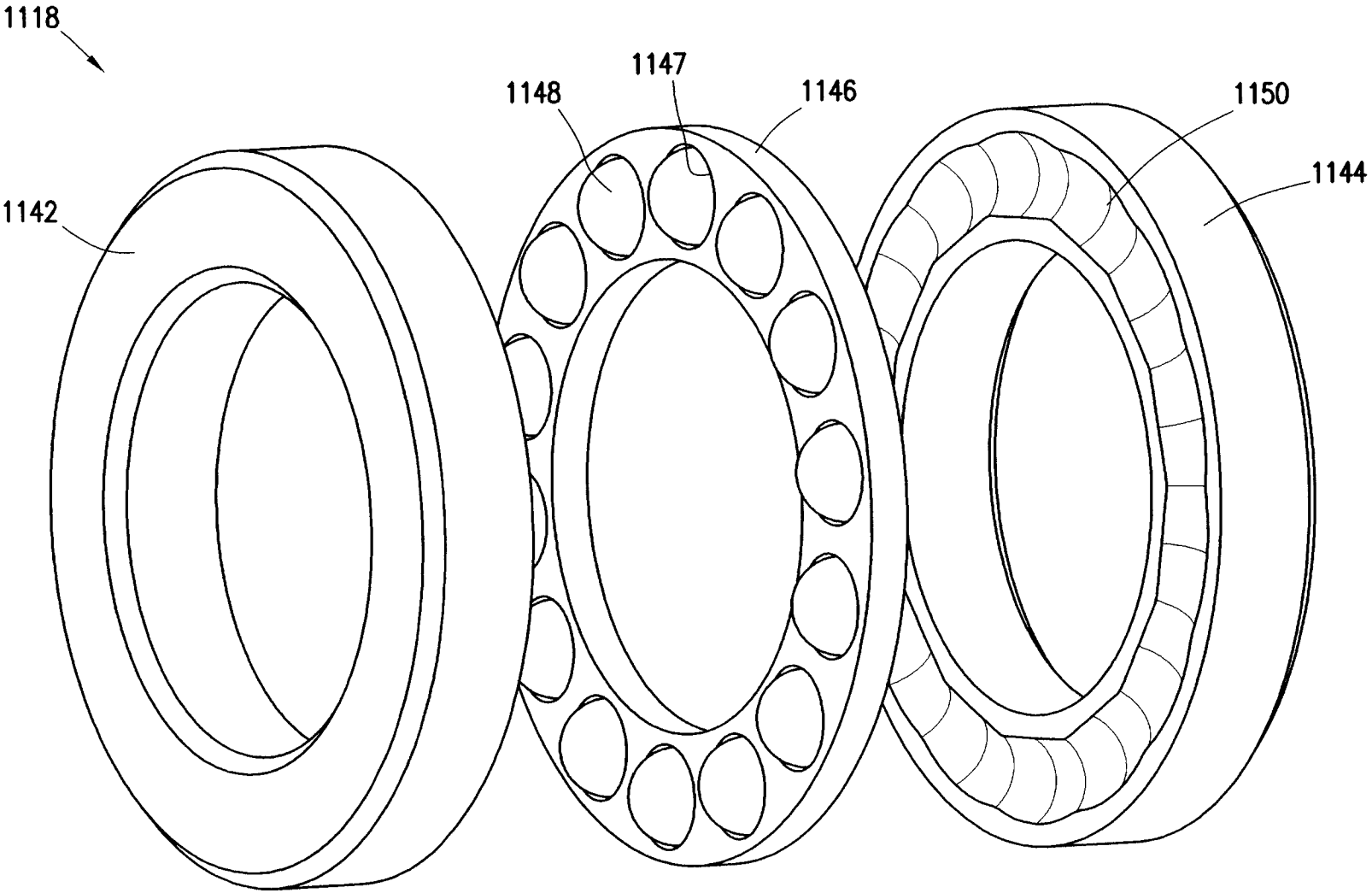
FIG. 11 is an exploded view of a portion of a vibration assembly with spherical rollers.
Figure 12:
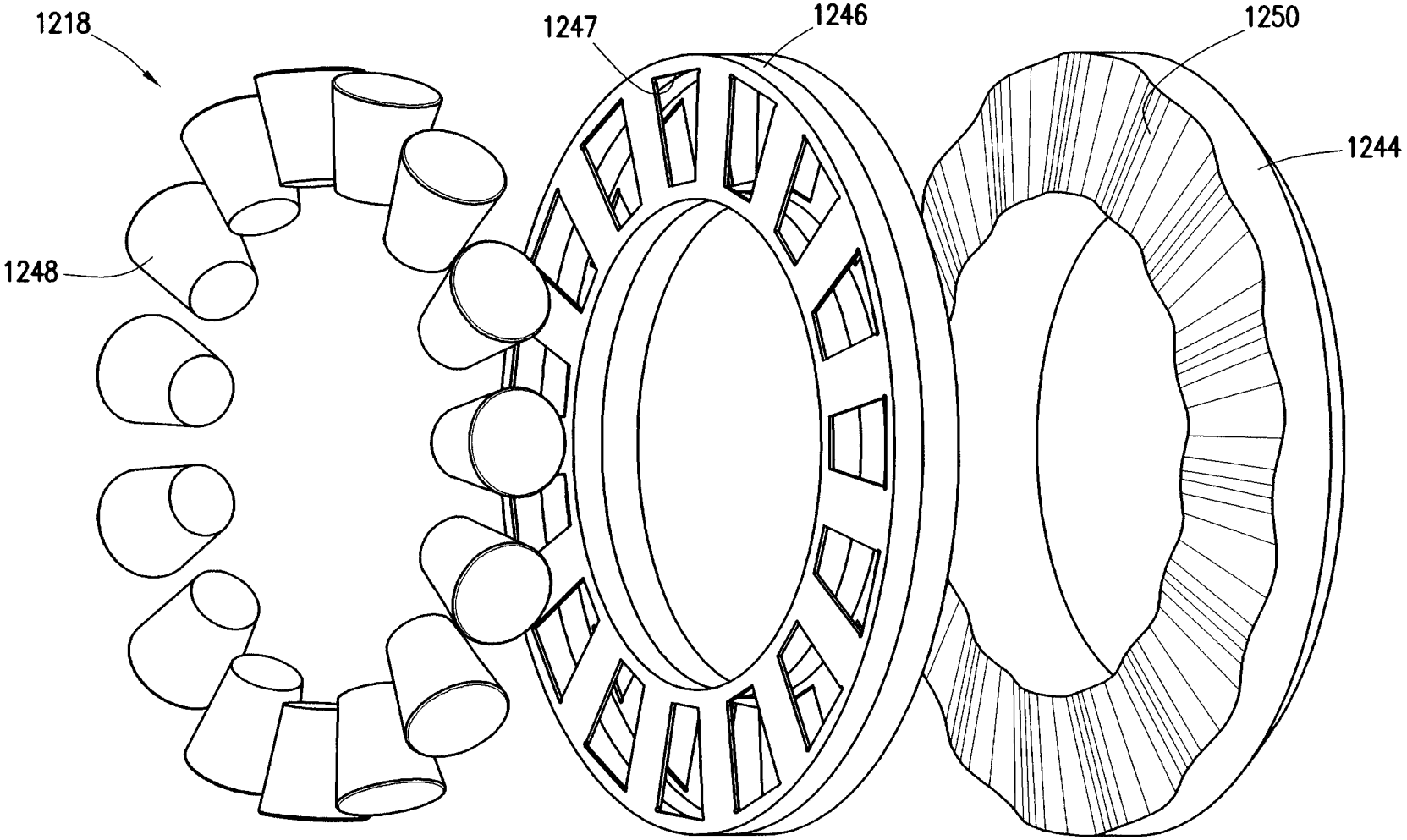
FIG. 12 is an exploded view of a portion of a vibration assembly with frusto-conical rollers.
Figure 13:
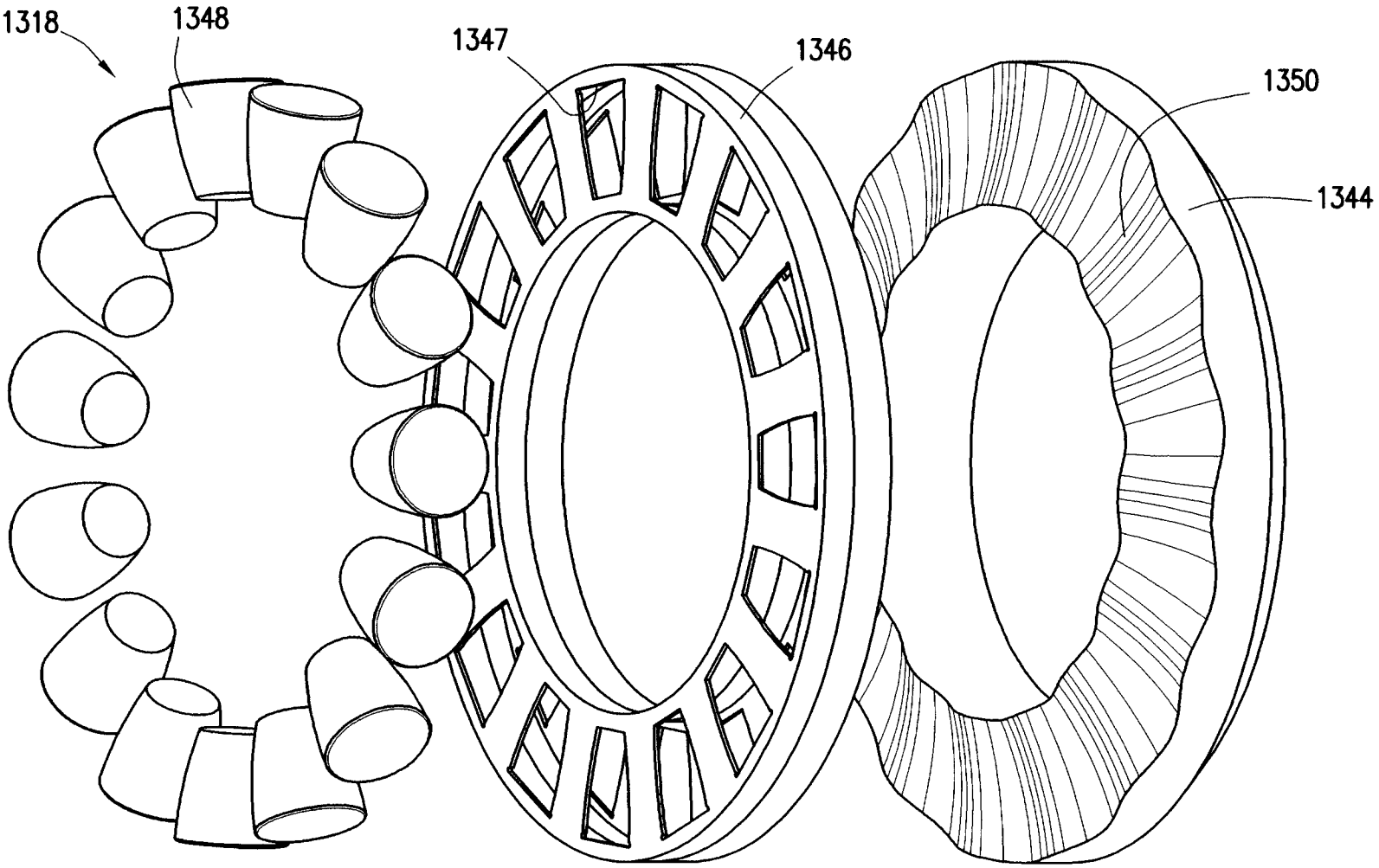
FIG. 13 is an exploded view of a portion of a vibration assembly with sphero-conical rollers.

FIGS. 11-13 show various other configurations of the vibration assemblies 1118,1218,1318. As shown in these versions, various shapes of a bearing race 1142, vibration races 1144, 1244, 1344, cages 1146, 1246, 1346, and/or rollers 1148, 1248, 1348 may be provided.

In the version of FIG. 11, the bearing assembly 1118 is provided with a donut shaped bearing race 1142 and the vibration race 1144 with an indented engagement surface 1150 thereon. The indented engagement surface 1150 is indented into a surface of the vibration race 1144. The cage 1146 is similar to the cages described herein, except that the cage 1146 has holes 1147 shaped to receive the spherical rollers 1148. The engagement surface 1150 is also shaped to receivingly engage the spherical rollers 1148 as they roll therealong.

In the version of FIG. 12, the portion of the bearing assembly 1218 is depicted as including the vibration race 1244 with an engagement surface 1250 thereon. The cage 1246 is similar to the cages described herein, except that the cage 1246 has openings 1247 configured to receive frusto-conical rollers 1248. The engagement surface 1250 may be an engagement surface similar to those described herein, except that it is also shaped to receivingly engage the frusto-conical rollers 1248 as they roll therealong.

In the version of FIG. 13, a portion of the bearing assembly 1318 is depicted as including and the vibration race 1344 with an engagement surface 1350 thereon. The cage 1346 is similar to the cages described herein, except that the cage 1346 has openings 1347 configured to receive sphero-conical rollers 1348. Sphero-conical means that the rollers 1348 have a rounded and tapered surface between a first end having a diameter smaller than a diameter of a second end thereof. The engagement surface 1350 may be an engagement surface similar to those described herein, except that it is also shaped to receivingly engage the sphero-conical rollers 1348 as they roll therealong.

Figure 14B:
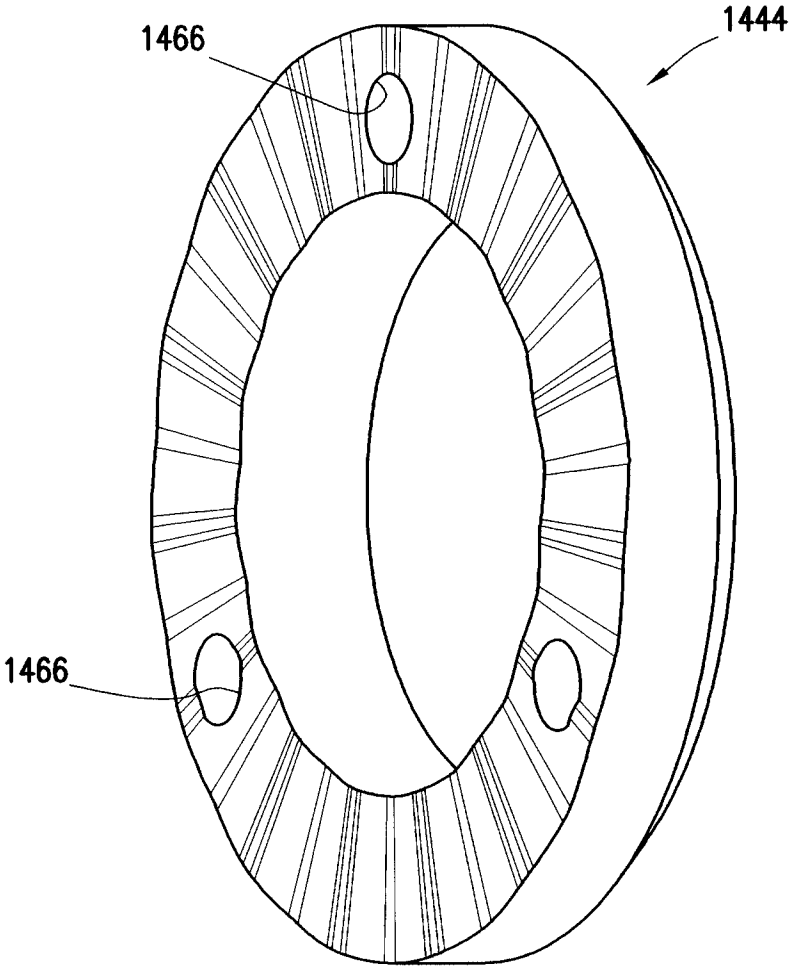
FIGS. 14A and 14B are side and perspective views, respectively, of a mounting vibration race.
Figure 14A:
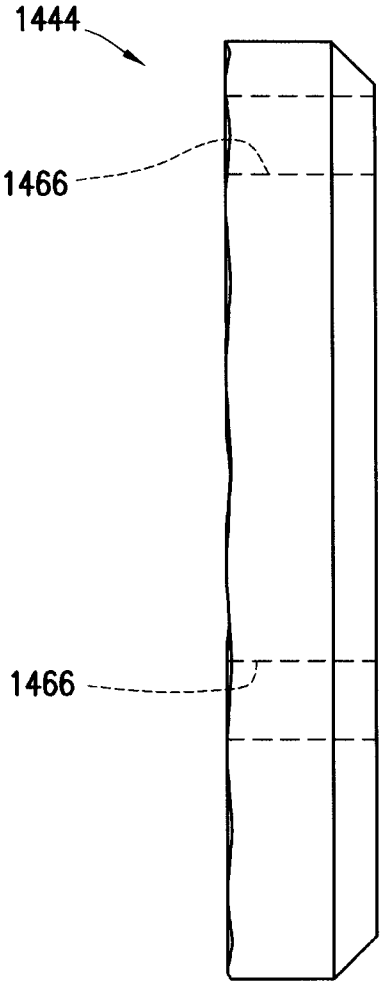

FIGS. 14A and 14B show another variation of the vibration race 1444 in a mounted configuration. This version may be similar to the vibration races described herein, except with holes 1466 for passing connectors, such as connectors 250 of FIG. 2B, therethrough for mounting the vibration assembly in position. As shown, the vibration race 1444 has 3 holes 1466 disposed thereabout, but any configuration may be provided.

While specific configurations of the vibration assemblies herein are provided, it will be appreciated that variations in shape and/or dimension may be provided. For example, while specific examples of rollers in openings of the cage are depicted, the rollers may optionally be of any shape, such as tapered, conical, spherical or other shapes. In another example, variations in the shapes of the waves along the engagement surface may be provided to achieve the desired range, speed, and/or type of motion.

Figure 15:
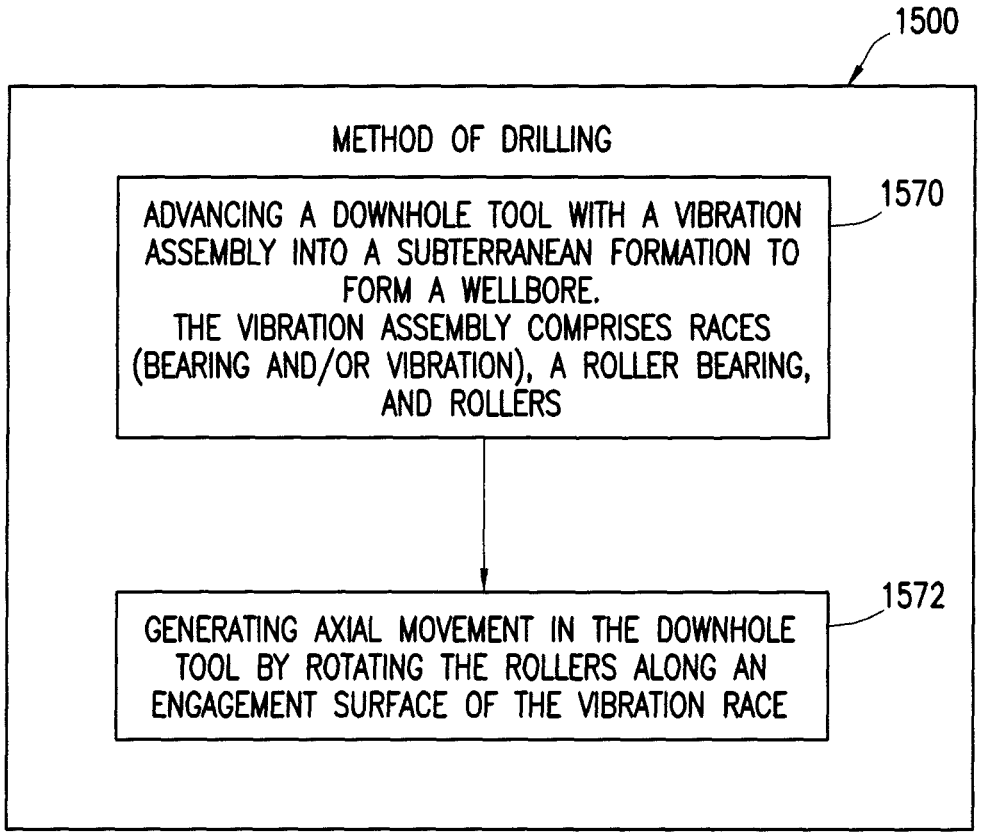
FIG. 15 is a flow chart depicting a method of drilling.

FIG. 15 is a flow chart depicting a method of drilling 1500. The method 1500 involves advancing 1570 a downhole tool with a vibration assembly into a subterranean formation to form a wellbore. The vibration assembly comprises races (e.g., a bearing race and/or a vibration race), a cage, and rollers as described herein. The method 1500 further involves 1572 generating axial movement in the downhole tool by rolling the rollers along an engagement surface of the vibration race. The method may be performed in any order and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, various shapes and/or configurations of the vibration assembly and/or its components may be used. Various combinations of features described herein may be provided.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A vibration assembly for a downhole tool positionable in a subterranean formation, the vibration assembly comprising:

a vibration race positioned in the downhole tool, the vibration race having a non-planar engagement surface comprising a plurality of valleys, a plurality of ramps, and a plurality of flat peaks, wherein each flat peak is positioned between a pair of the plurality of ramps, each valley has a first radius, and each ramp has a second radius that is different from the first radius;

an additional race positioned in the downhole tool a distance from the vibration race, the additional race having another engagement surface facing the non-planar engagement surface of the vibration race; and a cage positioned between the vibration race and the additional race; and rollers rollably engageable with the non-planar engagement surface and the another engagement surface to vary the distance between the vibration race and the additional race whereby axial movement is provided in the downhole tool.

2. The vibration assembly of claim 1, wherein the additional race is a bearing race and wherein the another engagement surface is a planar engagement surface.

3. The vibration assembly of claim 1, wherein the additional race is another vibration race having another non-planar surface.

4. The vibration assembly of claim 3, wherein the additional race is identical to the vibration race.

5. The vibration assembly of claim 1, wherein the rollers are one of cylindrical, spherical, and frusta-conical.

6. The vibration assembly of claim 1, wherein the non-planar engagement surface is a wavy surface extending radially about the vibration race.

7. The vibration assembly of claim 1, wherein the non-planar engagement surface is a circular channel extending into an inner surface of the vibration race, the circular channel having a non-smooth surface.

8. The vibration assembly of claim 1, wherein the ramps and the valleys of the non-planar engagement surface are in one of a smooth curved configuration, a sinusoidal configuration, a stepped configuration, a ramped configuration, a symmetric configuration, an asymmetric configuration, and combinations thereof.

9. The vibration assembly of claim 1, wherein the vibration race and the additional race have connector holes to receive connectors therethrough for connection to the downhole tool.

10. The vibration assembly of claim 1, further comprising a cage positioned between the vibration race and the additional race, the rollers being positionable in the cage.

11. The vibration assembly of claim 10, wherein:

the vibration race, the additional race, and the cage are ring-shaped members with a passage extending therethrough; and the cage has roller holes to receive the rollers therein.

12. A downhole tool positionable in a subterranean formation, the downhole tool comprising:

a conveyance; and a bottomhole assembly supported by the conveyance, the bottomhole assembly comprising a housing and a vibration assembly, the vibration assembly comprising:

a vibration race positioned in the downhole tool, the vibration race having a non-planar engagement surface comprising a plurality of valleys, a plurality of ramps, and a plurality of flat peaks, wherein each flat peak is positioned between a pair of the plurality of ramps, each valley having has a first radius and each ramp has a second radius that is different from the first radius;

an additional race positioned in the downhole tool a distance from the vibration race, the additional race having another engagement surface facing the non-planar engagement surface of the vibration race; and rollers rollably engageable with the non-planar engagement surface and the another engagement surface to vary the distance between the vibration race and the additional race whereby axial movement is provided in the downhole tool.

13. The downhole tool of claim 12, wherein the conveyance is a drill string and the bottomhole assembly comprises a motor assembly, a bearing assembly, and a drill bit, the vibration assembly positioned in the bearing assembly.

14. The downhole tool of claim 12, wherein:

the bottomhole assembly comprises a drive portion, an adjustment portion, and a bearing assembly, the vibration assembly positioned in the bearing assembly; and the bearing assembly comprises a crossover housing, bearing housings, and a bearing mandrel.

15. The downhole tool of claim 12, wherein:

the bottomhole assembly comprises an adjustment portion, and a bearing assembly;

the adjustment portion comprises a bearing housing, a bearing mandrel, a lock housing, and an adjustment ring, the vibration assembly positioned between the bearing housing and the bearing mandrel.

16. The downhole tool of claim 12, wherein the vibration assembly comprises a cage positioned between the vibration race and the additional race, the rollers being positionable in the cage.

17. A method of drilling a wellbore penetrating a subterranean formation, the method comprising:

advancing a downhole tool with a vibration assembly into the subterranean formation, the vibration assembly comprising:

a vibration race positioned in the downhole tool, the vibration race having a non-planar engagement surface comprising a plurality of valleys, a plurality of ramps, and a plurality of flat peaks, wherein each flat peak is positioned between a pair of the plurality of ramps, each valley has a first radius, and each ramp has a second radius that is different from the first radius;

an additional race positioned in the downhole tool a distance from the vibration race, the additional race having another engagement surface facing the non-planar engagement surface of the vibration race; and rollers in engagement with the non-planar engagement surface and the another engagement surface generating axial movement in the downhole tool by rotating the rollers along the non-planar engagement surface of the vibration race.

18. The method of claim 17, wherein the generating comprises varying the distance between the vibration race and the additional race by rotating the rollers along the non-planar engagement surface of the vibration race.

* * * * *